US010307919B2

(12) United States Patent
Lau

(10) Patent No.: US 10,307,919 B2
(45) Date of Patent: Jun. 4, 2019

(54) SANDWICH STRUCTURED CUTTER AND PERSONAL HAIR TRIMMER USING THE SAME

(71) Applicant: SPECIALIFE (ZHUHAI) CO., LTD., Zhuhai, Guangdong (CN)

(72) Inventor: Tung Yan Lau, Guangdong (CN)

(73) Assignee: SPECIALIFE (ZHUHAI) CO., LTD., Zhuhai (CN)

( * ) Notice: Subject to any disclaimer, the term of this patent is extended or adjusted under 35 U.S.C. 154(b) by 0 days.

(21) Appl. No.: 15/802,494

(22) Filed: Nov. 3, 2017

(65) Prior Publication Data

US 2018/0141223 A1 May 24, 2018

(30) Foreign Application Priority Data

Nov. 21, 2016 (CN) ..... 2016 1 1042941

(51) Int. Cl.

| | |
|---|---|
| ***B26B 19/06*** | (2006.01) |
| ***B26B 21/08*** | (2006.01) |
| ***B26B 21/40*** | (2006.01) |
| ***B26B 19/38*** | (2006.01) |
| ***B26B 19/10*** | (2006.01) |

(52) U.S. Cl.

CPC ..... *B26B 19/06* (2013.01); *B26B 19/102* (2013.01); *B26B 19/3846* (2013.01); *B26B 21/08* (2013.01); *B26B 21/4006* (2013.01); *B26B 21/4075* (2013.01)

(58) Field of Classification Search

CPC ... B26B 19/06; B26B 19/102; B26B 19/3846; B26B 21/08; B26B 21/4075; B26B 21/4006; B26B 19/3893; B26B 19/384; B26B 19/143

USPC ..... 30/208, 223, 216, 43.91

See application file for complete search history.

(56) References Cited

U.S. PATENT DOCUMENTS

| | | | | |
|---|---|---|---|---|
| 9,782,903 | B2 * | 10/2017 | Stapelbroek | B26B 19/3846 |
| 2011/0119929 | A1 * | 5/2011 | Lau | B26B 19/06 30/208 |
| 2014/0311306 | A1 * | 10/2014 | Sablatschan | B26B 19/3846 83/13 |

(Continued)

FOREIGN PATENT DOCUMENTS

| | | | | |
|---|---|---|---|---|
| EP | 2857154 | A1 | 4/2015 | |
| WO | WO 2015/158923 | A1 * | 10/2015 | B26B 19/06 |

OTHER PUBLICATIONS

1st Office Action of counterpart Chinese Patent Application No. 201611042941.7 dated Aug. 28, 2017.

*Primary Examiner* — Ghassem Alie

(57) ABSTRACT

The disclosure provides a sandwich structured cutter, which includes two fixed blades and a reciprocating blade sandwiched between the two fixed blades; edges of front ends of both the two fixed blades are provided with a row of comb teeth, an inner surface of each comb tooth contacting the reciprocating blade forms an acute angle with a lateral edge of the comb tooth; an edge of a front end of the reciprocating blade is provided with a row of cutting teeth with cutting edges; the edges of the front ends of the two fixed blades are overlapped with each other, the edge of the front end of the reciprocating blade is sandwiched between the edges of the front ends of the two fixed blades and is not exposed out of the edge of the front end of any one fixed blade.

8 Claims, 3 Drawing Sheets

(56) References Cited

U.S. PATENT DOCUMENTS

2015/0047203 A1* 2/2015 Stapelbroek ..... B26B 19/06
30/43.6

* cited by examiner

SANDWICH STRUCTURED CUTTER AND PERSONAL HAIR TRIMMER USING THE SAME

CROSS-REFERENCE TO RELATED APPLICATIONS

This application claims priority to Chinese Application No. 201611042941.7 filed on Nov. 21, 2016, the entire contents of which are hereby incorporated by reference.

TECHNICAL FIELD

The disclosure relates to the technical field of personal care supplies, and in particular to a sandwich structured cutter composed of two fixed blades and a reciprocating blade, and a personal hair trimmer using the same cutter.

BACKGROUND

Traditional personal hair trimming devices, for example, electric clippers, electric shavers and the like, all are composed of a blade set and a main body assembly. A main body part of the blade set includes a fixed blade and a reciprocating blade which are overlapped with each other. An edge of a front end of the reciprocating blade is provided with a row of cutting teeth. Both left and right edges of each cutting tooth are provided with a cutting edge. An edge of a front end of the fixed blade is provided with a row of comb teeth. An inner surface of each comb tooth contacting the reciprocating blade forms an acute angle with a lateral edge of the comb tooth. The edge of the front end of the reciprocating blade is overlapped with the edge of the front end of the fixed blade. The reciprocating blade is driven by a drive unit stretched out from the main body assembly, so that the edge of the front end of the reciprocating blade makes reciprocating motion with respect to the edge of the front end of the fixed blade, thereby trimming hairs stretching into gaps between the comb teeth of the fixed blade.

However, as the reciprocating blade, particularly the cutting teeth on the edge of the front end of the reciprocating blade, is exposed or partially exposed, a user may be easily hurt, or a psychological fear may be brought to the user.

SUMMARY

In order to solve the defects and shortages of existing technologies, the disclosure aims to provide a new type cutter of which a reciprocating blade is not exposed and which has a higher trimming efficiency, and provide a personal hair trimmer using the same cutter.

The aim of the disclosure is realized through a technical scheme as follows.

A sandwich structured cutter includes two fixed blades and a reciprocating blade sandwiched between the two fixed blades, wherein edges of front ends of both the two fixed blades are provided with a row of comb teeth, an inner surface of each comb tooth contacting the reciprocating blade forms an acute angle with a lateral edge of the comb tooth, an edge of a front end of the reciprocating blade is provided with a row of cutting teeth having cutting edges, the edges of the front ends of the two fixed blades are overlapped with the edge of the front end of the reciprocating blade, wherein the edges of the front ends of the two fixed blades are overlapped with each other, the edge of the front end of the reciprocating blade is sandwiched between the edges of the front ends of the two fixed blades, and the edge of the front end of the reciprocating blade is not exposed out of the edge of the front end of any one fixed blade, and the reciprocating blade is drivable, so that the edge of the front end of the reciprocating blade thereof makes reciprocating motion relative to the edges of the front ends of the two fixed blades, thereby realizing trimming of hairs.

Preferably, a cross section of the cutting tooth of the reciprocating blade, which is perpendicular to the length direction of the reciprocating blade, is a parallelogram, upper and lower opposite sides of the parallelogram align and close to corresponding inner surfaces of the comb teeth of the two fixed blades respectively.

Preferably, all of the cutting teeth of the reciprocating blade are arranged in a same direction.

Preferably, each of the cutting teeth of the reciprocating blade is arranged to be perpendicular to the edge of the front end of the reciprocating blade, or, each of the cutting teeth of the reciprocating blade is arranged to be inclined in a same direction at a same angle with respect to the edge of the front end of the reciprocating blade.

Preferably, the parallelograms of every two adjacent cutting teeth of the reciprocating blade are inclined towards each other, such that, on upper and lower ends of the every two adjacent cutting teeth, the cutting teeth are close to each other on one end while the cutting teeth are far away from each other on the other end to form a trapezoid construction.

Preferably, the two fixed blades are of a teeth overlapped structure, that is, the comb teeth of one fixed blade are overlapped with the comb teeth of the other fixed blade in a one-to-one correspondence manner, and gaps between the comb teeth of one fixed blade also are overlapped with gaps between the comb teeth of the other fixed blade in a one-to-one correspondence manner.

Preferably, the two fixed blades are of a teeth staggered structure, that is, the comb teeth of one fixed blade are overlapped with the gaps between the comb teeth of the other fixed blade in a one-to-one correspondence manner.

The disclosure further provides a personal hair trimmer using any one of the above sandwich structured cutters, which includes a main body assembly and a blade set; the blade set includes a cutter composed of a reciprocating blade and a fixed blade; and a drive mechanism used for driving the reciprocating blade is arranged inside the main body assembly.

Compared with existing technologies, the disclosure has advantages as follows.

1. The sandwich structure allows the cutting teeth of the reciprocating blade to be sandwiched between the comb teeth of the fixed blades, thereby avoiding the exposure of the cutting teeth of the reciprocating blade. The safety is higher.

2. The cross section of the cutting tooth of the reciprocating blade is of a parallelogram, so that two acute angles of the cross section of the cutting tooth of the reciprocating blade realize two times of trimming when the reciprocating blade makes reciprocating motion one time with respect to the fixed blades. The trimming efficiency is improved.

3. The fixed blades may adopt a teeth overlapped structure or a teeth staggered structure, which are applicable to different hair trimmers and different users.

DESCRIPTION OF THE EMBODIMENTS

Embodiment 1

Figure 1:
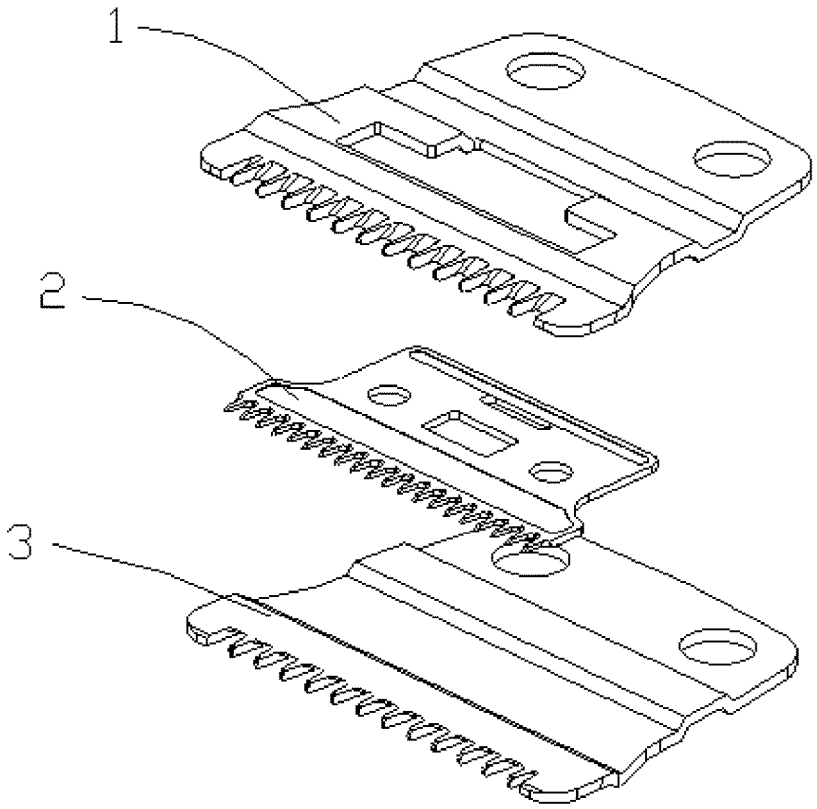
FIG. 1 is an exploded view of a sandwich structured cutter according to a first embodiment of the disclosure.
Figure 2:
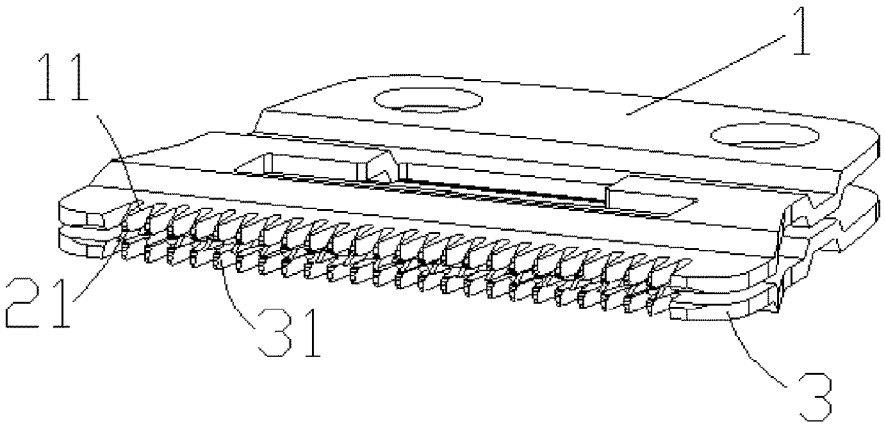
FIG. 2 is a combined view of a sandwich structured cutter according to a first embodiment of the disclosure.
Figure 3:
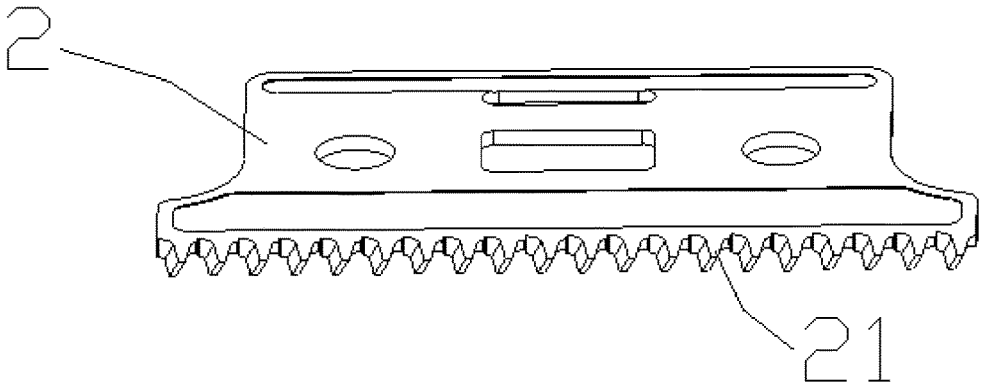
FIG. 3 is a perspective view of a reciprocating blade according to a first embodiment of the disclosure.

As shown in FIGS. 1 to 3, this embodiment provides a sandwich structured cutter, which is formed by two fixed blades 1, 3 and a reciprocating blade 2. The reciprocating blade 2 is sandwiched between the two fixed blades 1, 3. Edges of front ends of the two fixed blades 1, 3 are provided with a row of comb teeth 11, 31 respectively, and an inner surface of each comb tooth contacting the reciprocating blade 2 forms an acute angle with a lateral edge of the comb tooth. An edge of a front end of the reciprocating blade 2 is provided with a row of cutting teeth 21 having cutting edges. The edges of the front ends of the two fixed blades 1, 3 are overlapped with the edge of the front end of the reciprocating blade 2. Herein, the edges of the front ends of the two fixed blades 1, 3 are overlapped with each other, the edge of the front end of the reciprocating blade 2 is sandwiched between the edges of the front ends of the two fixed blades 1, 3 and is not exposed out of the edge of the front end of any one of the fixed blades 1, 3. The reciprocating blade 2 can be driven by a drive mechanism matched with the cutter, so that the edge of the front end of the reciprocating blade 2 makes reciprocating motion between the edges of the front ends of the two fixed blades 1, 3; during the reciprocating process, trimming edges are formed between the edge of the cutting tooth 21 of the reciprocating blade 2, that is, the cutting edge, and the acute angle of each comb tooth 11 or 31 of the fixed blade 1 or 3, so as to trim hairs.

A cross section of the cutting tooth 21 of the reciprocating blade 2, which is perpendicular to the length direction of the reciprocating blade, is of a parallelogram, upper and lower opposite sides of the parallelogram align and close to corresponding inner surfaces of the comb teeth 11, 31 of the two fixed blades 1, 3 respectively. Two opposite acute angles of the parallelogram serve as cutting edges.

All of the cutting teeth 21 of the reciprocating blade 2 are arranged in a same direction. Specifically, each of the cutting teeth 21 of the reciprocating blade 2 is arranged to be perpendicular to the edge of the front end of the reciprocating blade 2.

Comb teeth 11, 31 of the two fixed blades 1, 3 are in up down one-to-one correspondence, forming a teeth overlapped structure.

Embodiment 2

Figure 4:
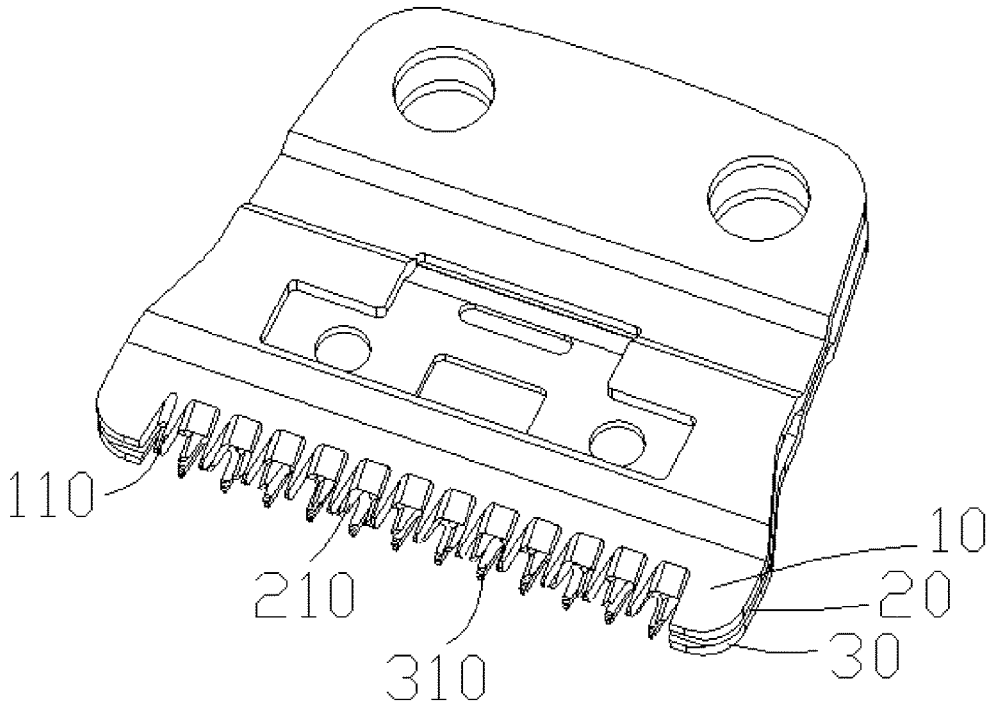
FIG. 4 is a combined view of a sandwich structured cutter according to a second embodiment of the disclosure.

This embodiment provides another sandwich structured cutter. As shown in FIG. 4, this embodiment is similar to the Embodiment 1, with the only difference that the two fixed blades 10, 30 are of a teeth staggered structure, that is, the comb teeth 110 of one fixed blade 10 are overlapped with the gaps between the comb teeth 310 of the other fixed blade 30 in a one-to-one correspondence manner. The cutting teeth 210 of the reciprocating blade 20 all are sandwiched between the comb teeth 110, 310 of the fixed blades.

Embodiment 3

Figure 5:
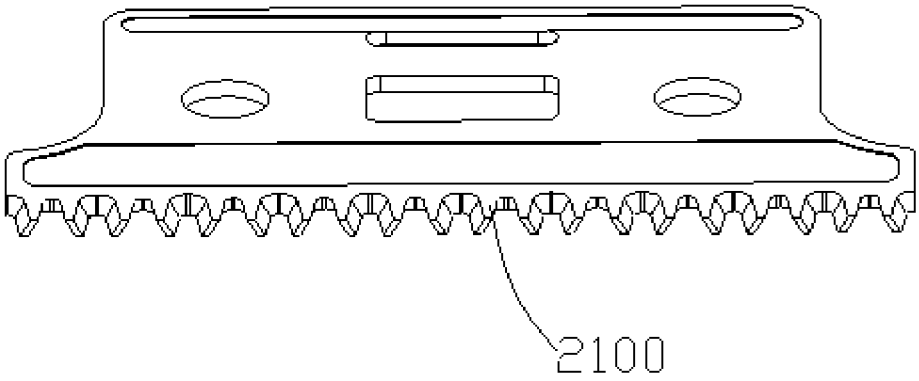
FIG. 5 is a perspective view of a reciprocating blade of a sandwich structured cutter according to a third embodiment of the disclosure.

This embodiment provides yet another sandwich structured cutter. As shown in FIG. 5, this embodiment is similar to the Embodiment 1, with the only difference that the parallelogram of every two adjacent cutting teeth 2100 of the reciprocating blade are inclined towards each other, such that, on upper and lower ends of the every two adjacent cutting teeth 2100, the cutting teeth are close to each other on one end while the cutting teeth are far away from each other on the other end to form a trapezoid construction.

Embodiment 4

This embodiment provides still yet another sandwich structured cutter. This embodiment is similar to the Embodiment 2, that is, the two fixed blades are of a teeth staggered structure, while the structure of the reciprocating blade is the same as or similar to that of the Embodiment 3, that is, every two adjacent cutting teeth of the reciprocating blade are inclined towards each other, such that, on upper and lower ends of the every two adjacent cutting teeth, the cutting teeth are close to each other on one end while the cutting teeth are far away from each other on the other end to form a trapezoid construction.

In the above Embodiment 1 and Embodiment 2, all of the cutting teeth of the reciprocating blade are arranged in a same direction, besides the above condition that each of the cutting teeth of the reciprocating blade is arranged to be perpendicular to the edge of the front end of the reciprocating blade, a condition as follows may exist that each of the cutting teeth of the reciprocating blade is arranged to be inclined in a same direction at a same angle with respect to the edge of the front end of the reciprocating blade.

It should be noted that, for the ordinary skill in this field, multiple improvements and modifications may be made without departing from the idea of the disclosure, and these improvements and modifications are intended to be included in the scope of protection of the disclosure. Therefore, the scope of protection of the patent of the disclosure should be based on claims appended herein.

What is claimed is:

1. A sandwich structured cutter, wherein the sandwich structured cutter comprises two fixed blades and a reciprocating blade sandwiched between the two fixed blades, edges of front ends of both the two fixed blades are provided with a row of comb teeth, an inner surface of each comb tooth contacting the reciprocating blade forms an acute angle with a lateral edge of the comb tooth, an edge of a front end of the reciprocating blade is provided with a row of cutting teeth having cutting edges, the edges of the front ends of the two fixed blades are overlapped with each other, the edge of the front end of the reciprocating blade is sandwiched between the edges of the front ends of the two fixed blades, and the edge of the front end of the reciprocating blade is not exposed out of the edge of the front end of any one fixed blade, and the reciprocating blade is drivable, so that the edge of the front end of the reciprocating blade thereof makes reciprocating motion relative to the edges of the front ends of the two fixed blades, thereby realizing trimming of hairs, wherein a cross section of the cutting tooth of the reciprocating blade, which is perpendicular to the length direction of the reciprocating blade, is of a parallelogram, and upper and lower opposite sides of the parallelogram align and close to corresponding inner surfaces of the comb teeth of the two fixed blades respectively, and wherein two opposite acute angles of the parallelogram define two cutting edges of the cutting tooth.

2. The cutter according to claim 1, wherein all of the cutting teeth of the reciprocating blade are arranged in a same direction.

3. The cutter according to claim 2, wherein each of the cutting teeth of the reciprocating blade is arranged to be perpendicular to the edge of the front end of the reciprocating blade, or, each of the cutting teeth of the reciprocating blade is arranged to be inclined in a same direction at a same angle with respect to the edge of the front end of the reciprocating blade.

4. The cutter according to claim 1, wherein the parallelograms of every two adjacent cutting teeth of the reciprocating blade are inclined towards each other, such that, on upper and lower ends of the every two adjacent cutting teeth, the cutting teeth are close to each other on one end while the cutting teeth are far away from each other on the other end to form a trapezoid construction.

5. The cutter according to claim 1, wherein the two fixed blades are of a teeth overlapped structure, that is, the comb teeth of one fixed blade are overlapped with the comb teeth of the other fixed blade in a one-to-one correspondence manner, and gaps between the comb teeth of one fixed blade also are overlapped with gaps between the comb teeth of the other fixed blade in a one-to-one correspondence manner.

6. The cutter according to claim 1, wherein the two fixed blades are of a teeth staggered structure, that is, the comb teeth of one fixed blade are overlapped with the gaps between the comb teeth of the other fixed blade in a one-to-one correspondence manner.

7. A personal hair trimmer, comprising a main body assembly and a blade set, the blade set comprising a cutter composed of a reciprocating blade and a fixed blade, and a drive mechanism used for driving the reciprocating blade being arranged inside the main body assembly; wherein the cutter is of a sandwich structure, which comprises two fixed blades and a reciprocating blade sandwiched between the two fixed blades, edges of front ends of both the two fixed blades are provided with a row of comb teeth, an inner surface of each comb tooth contacting the reciprocating blade forms an acute angle with a lateral edge of the comb tooth, an edge of a front end of the reciprocating blade is provided with a row of cutting teeth having cutting edges, the edges of the front ends of the two fixed blades are overlapped with each other, the edge of the front end of the reciprocating blade is sandwiched between the edges of the front ends of the two fixed blades and is not exposed out of the edge of the front end of any one fixed blade, and the reciprocating blade is driven by the drive mechanism, so that the edge of the front end thereof makes reciprocating motion with respect to the edges of the front ends of the two fixed blades, thereby realizing trimming of hairs, wherein a cross section of the cutting tooth of the reciprocating blade, which is perpendicular to the length direction of the reciprocating blade, is of a parallelogram, and upper and lower opposite sides of the parallelogram are attached onto corresponding inner surfaces of the comb teeth of the two fixed blades respectively, and wherein two opposite acute angles of the parallelogram define two cutting edges of the cutting tooth.

8. The personal hair trimmer according to claim 7, wherein all of the cutting teeth of the reciprocating blade are arranged in a same direction, each of the cutting teeth of the reciprocating blade is arranged to be perpendicular to the edge of the front end of the reciprocating blade, or, each of the cutting teeth of the reciprocating blade is arranged to be inclined in a same direction at a same angle with respect to the edge of the front end of the reciprocating blade; every two adjacent cutting teeth of the reciprocating blade are inclined towards each other, such that, on upper and lower ends of the every two adjacent cutting teeth, the cutting teeth are close to each other on one end while the cutting teeth are far away from each other on the other end to form a trapezoid construction; the two fixed blades are of a teeth overlapped structure, that is, the comb teeth of one fixed blade are overlapped with the comb teeth of the other fixed blade in a one-to-one correspondence manner, and gaps between the comb teeth of one fixed blade also are overlapped with gaps between the comb teeth of the other fixed blade in a one-to-one correspondence manner; or, the two fixed blades are of a teeth staggered structure, that is, the comb teeth of one fixed blade are overlapped with the gaps between the comb teeth of the other fixed blade in a one-to-one correspondence manner.

* * * * *